US010295218B2

(12) United States Patent
Campbell et al.

(10) Patent No.: US 10,295,218 B2
(45) Date of Patent: May 21, 2019

(54) INSULATED DUCT WITH AIR GAP AND METHOD OF USE

(71) Applicant: FLEXIBLE TECHNOLOGIES, INC., Abbeville, SC (US)

(72) Inventors: Donald B. Campbell, Greenwood, SC (US); Ronald L. Carlay, II, Laurens, SC (US)

(73) Assignee: FLEXIBLE TECHNOLOGIES, INC., Abbeville, SC (US)

( * ) Notice: Subject to any disclaimer, the term of this patent is extended or adjusted under 35 U.S.C. 154(b) by 38 days.

(21) Appl. No.: 15/230,880

(22) Filed: Aug. 8, 2016

(65) Prior Publication Data

US 2017/0038091 A1 Feb. 9, 2017

Related U.S. Application Data

(60) Provisional application No. 62/201,717, filed on Aug. 6, 2015.

(51) Int. Cl.
*F24F 13/02* (2006.01)

(52) U.S. Cl.
CPC ..... *F24F 13/0218* (2013.01); *F24F 13/0263* (2013.01)

(58) Field of Classification Search
CPC ..... F24F 13/0218; F24F 13/0263
USPC ..... 138/114, 137, 140, 149, DIG. 4
See application file for complete search history.

(56) References Cited

U.S. PATENT DOCUMENTS

| | | | |
|---|---|---|---|
| 1,838,242 | A | 12/1931 | Wilson |
| 2,508,774 | A | 5/1950 | Eldon |
| 2,810,400 | A | 10/1957 | Hewitt |
| 2,861,598 | A | 11/1958 | Carder et al. |
| 2,936,792 | A | 5/1960 | Maccracken et al. |
| 3,126,918 | A | 3/1964 | Eaton |
| 3,216,459 | A | 11/1965 | Schroeder |
| 3,434,502 | A | 3/1969 | Snelling |
| 3,538,956 | A | 11/1970 | Helbing et al. |
| 3,554,237 | A | 1/1971 | Pelley et al. |
| 3,565,118 | A | 2/1971 | Stearns |
| 3,565,120 | A | 2/1971 | Bennett |
| 3,566,002 | A | 2/1971 | Brown |
| 3,568,722 | A | 3/1971 | Runshe et al. |
| 3,596,936 | A | 8/1971 | Dieckmann et al. |
| 3,810,491 | A | 5/1974 | Hildebrandt |
| 3,826,286 | A | 7/1974 | Beck |
| 3,974,862 | A | 8/1976 | Fuhrmann |

(Continued)

FOREIGN PATENT DOCUMENTS

| | | |
|---|---|---|
| EP | 1 666 784 | 6/2006 |
| GB | 1024954 | 4/1966 |

(Continued)

*Primary Examiner* — Craig M Schneider
*Assistant Examiner* — David R Deal
(74) *Attorney, Agent, or Firm* — Clark & Brody

(57) ABSTRACT

An insulated duct comprises a free floating liner, an optional bulk insulation layer, a vapor barrier, and a reflective insulation system. The reflective insulation system includes an air gap and a low-e surface. The gap is positioned between the bulk insulation layer and the low-e surface or the outer member and the low-e surface if no insulation is used to gain additional insulating value for the duct. With the free floating liner and the reflective insulation system, a duct can be made to an industry standard R-value while using bulk insulation with a lower R-value.

24 Claims, 9 Drawing Sheets

(56) References Cited

U.S. PATENT DOCUMENTS

| | | | |
|---|---|---|---|
| 4,037,626 | A | 7/1977 | Roberts |
| 4,172,474 | A | 10/1979 | Stahl |
| 4,182,378 | A | 1/1980 | Dieter |
| 4,209,043 | A | 6/1980 | Menzel |
| 4,410,014 | A | 10/1983 | Smith |
| 4,417,603 | A | 11/1983 | Argy |
| 4,531,551 | A | 7/1985 | Eichelberger et al. |
| 4,990,143 | A | 2/1991 | Sheridan |
| 5,129,428 | A | 7/1992 | Winter et al. |
| 5,526,849 | A | 6/1996 | Gray |
| 5,575,312 | A | 11/1996 | Schroeder |
| 5,607,529 | A | 3/1997 | Adamczyk et al. |
| 5,727,599 | A | 3/1998 | Fisher et al. |
| 5,785,091 | A | 7/1998 | Barker |
| 6,000,435 | A | 12/1999 | Patel et al. |
| 6,158,477 | A | 12/2000 | Waters |
| 6,234,163 | B1 | 5/2001 | Garrod |
| 6,527,013 | B2 | 3/2003 | Somerville et al. |
| 6,527,014 | B1 | 3/2003 | Aubourg |
| 6,666,233 | B1 | 12/2003 | Sorkin |
| 6,821,638 | B2 | 11/2004 | Obeshaw |
| 6,926,040 | B1 | 8/2005 | Prescott et al. |
| 7,140,396 | B2 | 11/2006 | Mota et al. |
| 7,442,121 | B2 | 10/2008 | Cassidy et al. |
| 8,186,387 | B2 | 5/2012 | Wadsworth |
| 8,371,338 | B2 | 2/2013 | Princell et al. |
| 8,469,062 | B2 | 6/2013 | Liebson et al. |
| 8,544,504 | B2 | 10/2013 | Castro |
| 2007/0131299 | A1 | 6/2007 | Kornbleet |
| 2010/0186846 | A1 | 7/2010 | Carlay et al. |
| 2015/0090360 | A1 | 4/2015 | Carlay |

FOREIGN PATENT DOCUMENTS

| | | |
|---|---|---|
| GB | 2124177 | 2/1984 |
| GB | 2326688 | 12/1998 |

INSULATED DUCT WITH AIR GAP AND METHOD OF USE

This application claims priority under 35 USC 119(e) based on provisional application No. 62/201,717, filed on Aug. 6, 2015.

FIELD OF THE INVENTION

The invention relates to an insulated duct that combines a reflective insulation system, a free floating liner, and bulk insulation to permit the use of bulk insulation with a smaller insulation value without lessening the overall insulation value of the insulated duct.

BACKGROUND ART

The construction of factory-made flexible HVAC ducts is well known in the industry. These types of ducts usually comprise a helical-supported duct liner (sometimes referred to as the core or inner core) covered by a layer of fiberglass insulation, which is, in turn, covered by a scrim-reinforced PET vapor barrier or a PE-film vapor barrier. Scrim is a woven material that adds strength to a laminate construction when made a part thereof. U.S. Pat. Nos. 6,158,477 and 5,785,091 show typical constructions of factory made ducts. U.S. Pat. No. 5,785,091 teaches that the duct liner and vapor barrier can be manufactured from polymer films, particularly polyester. U.S. Pat. No. 5,526,849 discloses a plastic helical member in combination with a metal helical member and U.S. Pat. No. 4,990,143 discloses a polyester helix. United States Patent Publication No. 2007/0131299 discloses a polyester scrim used in a vapor barrier.

In the prior art, factory-made flexible HVAC ducts are typically constructed of three main components; a duct liner for conveying air, a layer of insulation for preventing energy loss through the duct wall, and a vapor barrier for holding the fiberglass around the liner while protecting the fiberglass from moisture. The duct liner is commonly constructed of a steel wire sandwiched between layers of polyester (PET) film. Other plastics and coated fabrics are also used to construct the wall of the duct liner. United States Published Patent Application No. 2010/0186846 to Carlay et al. is another example of flexible duct and it is incorporated in its entirety herein.

Another example of a prior art duct is that shown in United States Published Patent Application No. 2015-0090360 to Carlay III. This duct has an inflatable jacket to create an air space around the duct core or liner to reduce the amount of bulk insulation in the duct without reducing the overall insulating value of the duct. While this duct is advantageous in terms of its insulating value, it has some drawbacks in terms of manufacture to create the inflatable jacket.

In the HVAC industry, ductwork is often times specified to have a certain thermal resistance or R value for a particular application. For example, if the ductwork is to run in an unconditioned space, the R value must be at least 6.0. Current North American flexible duct fiberglass R-values are R4.2, R6.0 and R8.0 and each may be purchased pre-certified from fiberglass manufacturers. Obviously, the cost of the ductwork increases from one that has an R6.0 value to an R8.0 value due to the need to provide additional insulation, which is generally fiberglass insulation.

In the HVAC industry, the fundamentals of heat transfer and the like are explained in the ASHRAE Handbook of Fundamentals (the Handbook), which is currently in a 2013 edition. Included in this Handbook is the recognition of reflective insulation systems, which combines a reflective insulation and an enclosed air space bounded within a particular assembly, see page 26.12 of the Handbook. The Handbook also recognize the effect of thermal resistance as it relates to a particular size air space and the direction of heat flow, e.g. up, down, oblique up or down, etc., see pages 26.13 and 26.14. What these pages generally show is that an increase in thermal resistance occurs when the air space or air gap increases and that the thermal resistance is the least when the heat flow is in the up direction.

However, there is always a need to provide improved duct designs in the HVAC industry and other areas where air or fluid handling is necessary. The present invention responds to this need by providing an improved insulated duct.

SUMMARY OF THE INVENTION

The invention provides an improved insulated duct through the combination of a reflective insulation system, bulk insulation, a helical member, and a free floating liner component of the insulated duct. The insulated duct includes a low-e surface and an air space (hereinafter air gap) between the low-e surface and the bulk insulation layer as the reflective insulation system. The helical member assists in creating the gap of the reflective insulation system. The reflective insulation system adds additional R value to the duct. This permits using bulk insulation of a less R value than normally used while still maintaining the desired overall R value of the inventive insulated duct. For example, the inventive insulated duct with bulk insulation of 4.2R value can create a duct with an overall R value of R6. Similar, an insulted duct with bulk insulation of R5 or R6 can create a duct with an overall R value of R8.

In one embodiment, the free floating liner includes the low-e surface on an outside thereof. The helical member is positioned and sized to support the bulk insulation and create separation between it and the low-e surface of the free floating liner to form the reflective insulation system.

In a second embodiment, the free floating liner includes the bulk insulation on its outer surface and the low-e surface is on the inside of the vapor barrier. The helical member is part of the vapor barrier and the vapor barrier with the helical member is sized to create the gap between the low-e surface and outside of the bulk insulation layer.

The invention also includes the use of the inventive duct to move conditioned air through the insulated duct.

Further yet, the invention includes a method of making an insulated duct having an overall R value that is greater than the R value of the bulk insulation used in the insulated duct. With the combination of the free floating liner, reflective insulation system and the bulk insulation, an insulated duct using a bulk insulation of 4.2R value can create an insulated duct with an overall R6 value. Similarly, an insulated duct using an R5 or R6 bulk insulation can create an insulated duct having an overall R8 value.

Another embodiment of the invention relates to an insulated flexible duct that uses at least one free floating liner and at least one reflective insulation system and does not include bulk insulation. The at least one free floating liner floats inside an outer member and forms a variable space air gap between the at least one free floating liner and the outer member. The at least one reflective insulation system comprising a low-e surface on either an outer surface of the at least one free floating liner or an inner surface of the outer member and the variable space air gap, with the low-e surface facing the variable space gap. The outer member would also serve as a vapor barrier.

This bulk insulation-free embodiment can use two or more free floating liners in combination with the outer liner. The more free floating liners that are used means more variable space air gaps and reflective insulation systems and an increase in the overall insulation value of the duct. This bulk insulation free embodiment can be used as a replacement for conventional HVAC flexible duct when handling conditioned air.

DETAILED DESCRIPTION OF THE INVENTION

Figure 1:
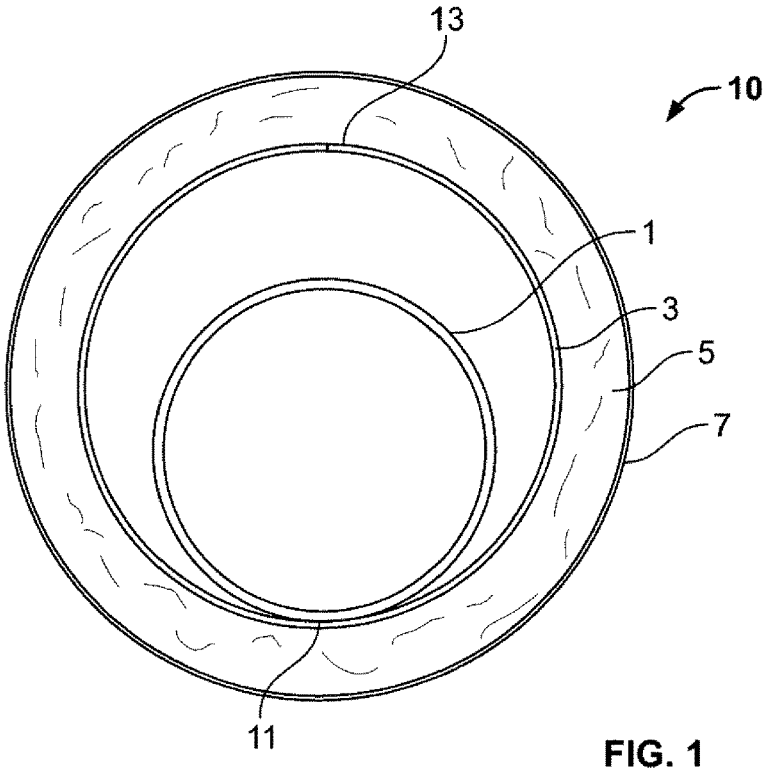
FIG. 1 is an end view of one embodiment of the inventive duct.

FIG. 1 shows an end view of one embodiment of the inventive duct. The duct is designated by the reference numeral 10 and includes a free floating liner 1 that forms a space 2 to allow for flow of air or other fluid through the duct 10. Surrounding the free floating liner 1 is a helical member 3.

Surrounding the helical member 3 is a layer of bulk insulation 5. The bulk insulation is preferably fiberglass batt but it can be any type of bulk insulation known for use in the HVAC industry. The helical member 3 is not attached to any other component of the duct, including the free floating liner 1 and bulk insulating layer 5 that the helical member resides between. Thus, the liner 1 is free floating within the confines created by the helical member 3 and bulk insulating layer 5.

Surrounding the bulk insulating layer 5 is a vapor barrier 7.

The vapor barrier 7 is a conventional layer used in ductwork and is commonly constructed of either a tubular extruded polyethylene film or a fiberglass rip-stop, i.e., a scrim, sandwiched between layers of a polyester film. In the case of polyester films, the outer layer of film can be a metallic-coated polyester film while the inner film is clear uncoated polyester film. The preferred polyester is polyethylene terephthalate, both as the inner and outer layers of the vapor barrier 7. A polyester scrim may be substituted for the fiberglass scrim. In fact, any type of known vapor barrier can be used to surround the bulk insulating layer 5. The vapor barrier 7 can be attached to the insulation using an adhesive or surround the insulation without attachment.

The helical member 3 forms a gap 9 between free floating liner 1 and the bulk insulating layer 5. The air in the gap 9 is essentially still as the ends of the duct are sealed to fittings when the ducts are attached or installed. As the duct 10 shown in FIG. 1 is in a horizontal configuration, the free floating liner rests on the helical member 3 at 11. In this horizontal configuration, the size of the gap 9 between the insulation 5 and the free floating liner 1 increases from the resting location 11 to a maximum at a location 13 diametrically opposed to the resting location 11. The helical member 3 can be made of any material that would provide sufficient support to form the gap 9, including both metal and non-metallic materials. Typically, these helical materials are made from spring steel, which is a preferred choice for the inventive duct. The size of the helical member 3 is dependent on the size of the free floating liner 1 as the helical member 3 determines the size of the gap 9 that contributes to the additional insulating value. The pitch of the helical member relates to the density of the insulation. The pitch is optimally sized to minimize sags of the insulation between the flights of the helical member, i.e., the spaces created by adjacent wire portions of the helical member. The helical member is typically sized to create about a ¼ to about a 5.5 inch air gap, preferably up to 3 inch.

Figure 7:
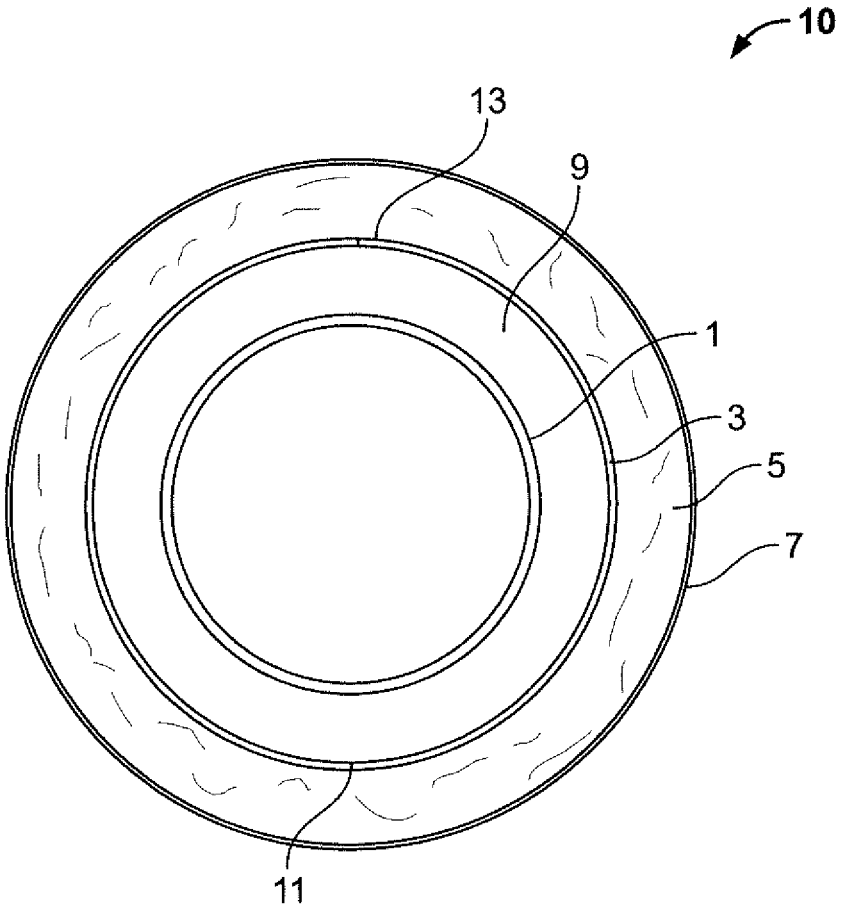
FIG. 7 is an end view of the duct of FIG. 1 in a generally vertical orientation.

The liner, whether configured in the first or second embodiments of the invention, is free floating by virtue of the fact that it is not attached to components of the duct that surround it, i.e., the helical member, the bulk insulation, and the vapor barrier. Because the liner is not attached, it is self-positioning within the duct based on the orientation of the duct. For example, if the duct is horizontal, the free floating liner will self-position itself as shown in FIG. 1, wherein the liner rests on the helical member due to gravity and the air gap is then the largest above the free floating liner. If the duct is non-vertical position, the orientation of the duct will determine the extent that the liner rests on the helical member and the configuration of the gap along the length of the duct. If the duct is purely vertical, the liner would be spaced from the helical member along the length of the duct so as to form an annular gap as shown in FIG. 7. Orientations of the duct between the pure vertical and pure horizontal would have the free floating liner resting on a portion of the helical member with the horizontal orientation of the duct having substantially the entire free floating liner resting on the helical member. The configuration of the free floating liner when two ducts and their respective liners are attached together is discussed below.

Figure 2:
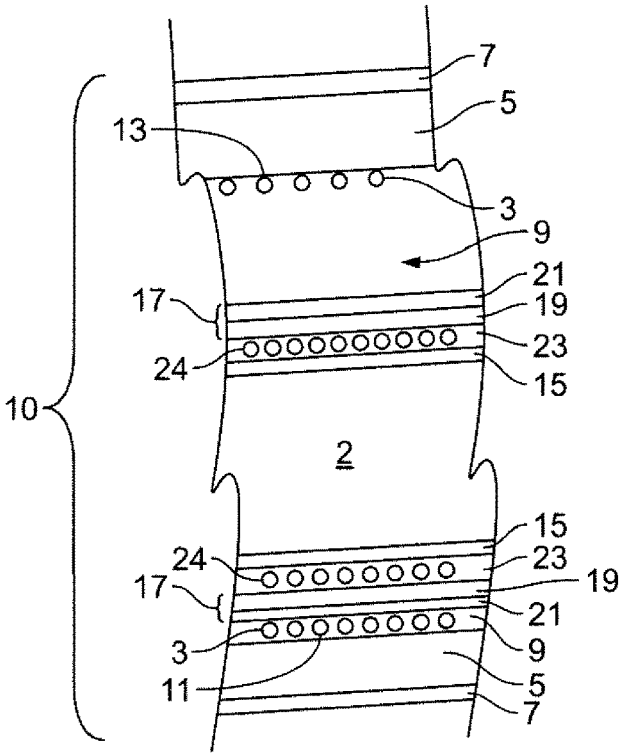
FIG. 2 is a schematic drawing of the layered construction of the inventive duct of FIG. 1.

FIG. 2 shows a schematic drawing of the layered construction of the duct. A wall of free floating liner 1 is made up of a polymer film 15 and a low emissivity film 17 (low-e film). The low-e film is located on the outer surface of the free floating liner 1 and it faces the gap 9.

The low-e film 17 is made of a polymer film 19, reflective coatings 21. A protective coating (not shown) can cover the reflective, e.g., metallic, coatings 21. The low-e film 17 is secured to the polymer film 15 using an adhesive 23. A helical support 24 is shown positioned between the films 15 and 17. The placement of the low-e film 17 on the outside of the free floating liner 1 and facing the gap 9 creates the reflective insulation system that provides additional insulating value to the overall duct 10. The additional R value created by the combination of the low-e film and gap 9 can range from R0 to about R4 depending on the size of the gap 9 and the emissivity of the low-e surface employed.

The use of low-e materials is well known in the art and they include metal foils or films coated with a reflective material, such as the film 17 described above. Some of these materials are made as a laminate construction with a polymer film such as polyester, and thin aluminum coating on a surface of the polyester. Some films can be overcoated with a protective coating on the metallic side to protect the reflective surface, e.g., from oxidation and/or loss of the coating itself. The metal film side can be used to insulate against radiant heating effects. Any type of low-e surface can be used with the invention.

Inclusion of a low-e material on the free floating liner 1 can be accomplished in any number of ways. The important point is that the outer surface of the free floating liner 1 has a low-e surface. This low-e surface could be derived from any number of materials, including the polymer film 17 shown in drawings, a metallic foil material, a laminate material, and the like.

A strengthening scrim (not shown) can also be used as part of the free floating liner 1, as is well known in the art, or the free floating liner wall can be made without the scrim.

The helical member 3 is sized in diameter to provide the gap 9 that would range at its maximum position 13 from about ¼ to 5.5 inches in thickness. The resulting reflective insulation system adds an insulating value to the duct, which can be up to about an additional R3. Exceeding the preferred upper limit for the gap thickness may add insulating value but it increases the overall diameter of the duct to an impractical size for use. Gap thicknesses below the minimum do not provide sufficient additional insulating value to increase the duct R value from one commercially applicable level to the next. This gap measurement is based on the configuration or orientation of the duct. For example, a vertical run of the duct would allow the free floating liner 1 to be more centered in the helical member 3, thus providing a more uniform gap 9 around the free floating liner 1. In a horizontal configuration, no gap exists underneath the free floating liner 1. The largest gap is created above the free floating liner 1 as shown in FIG. 1. In either configuration, i.e., a more annular gap or a maximum gap opposite where the free floating liner rests due to gravity, the combination of the free floating liner and reflective insulation system allows the creation of an insulated duct that can have an industry standard R value while using less bulk insulation.

Figure 3:
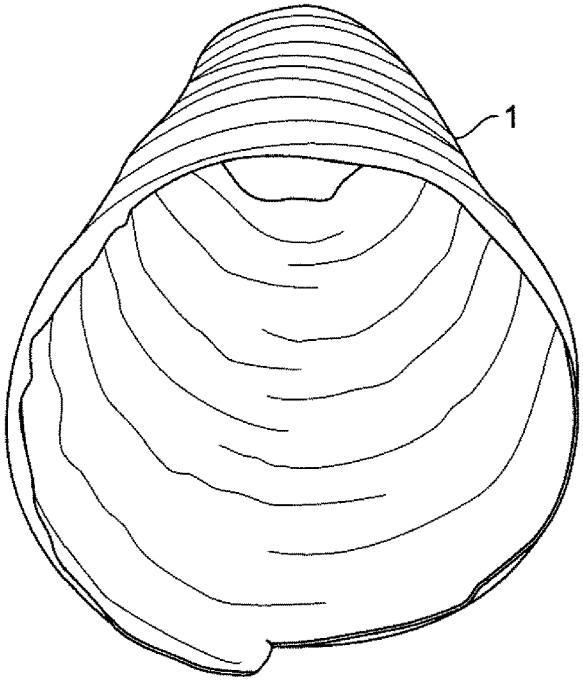
FIG. 3 is an end perspective view of the free floating liner of the duct of FIG. 1.
Figure 4:
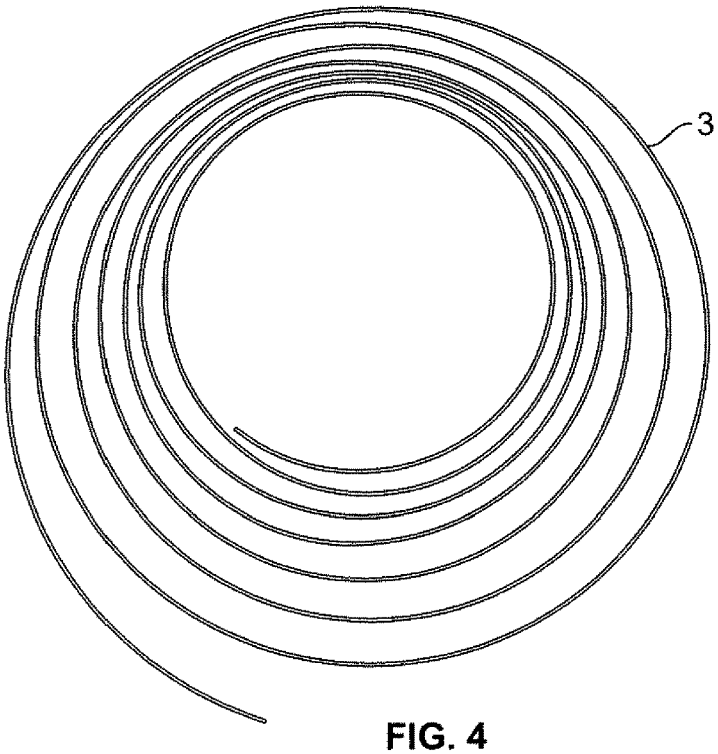
FIG. 4 is an end perspective view of the helical member of the duct of FIG. 1.
Figure 5:
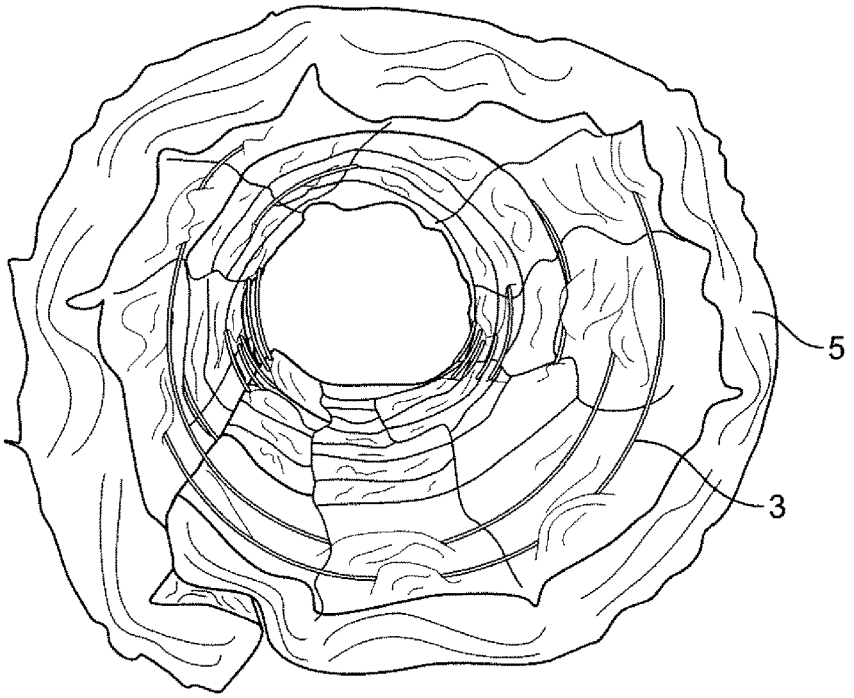
FIG. 5 is an end perspective view of the helical member and the bulk insulating layer of the duct of FIG. 1.
Figure 6:
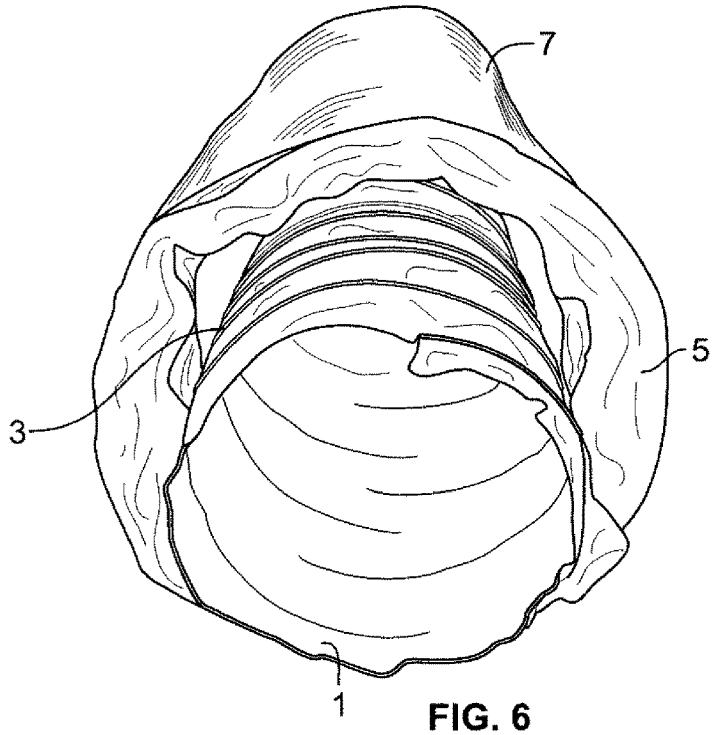
FIG. 6 is an end perspective view of the components of FIGS. 3-5 assembled into a duct.

FIGS. 3-6 show one embodiment of the duct in component views and assembled. FIG. 3 shows the free floating liner 1 and FIG. 4 shows the helical member 3. FIG. 5 shows the bulk insulating layer 5 with the helical member 3 inside it. FIG. 6 shows the assembled duct with the free floating liner 1, helical member 3, bulk insulating layer 5, and vapor barrier 7. FIG. 7 shows a duct in a generally vertical configuration. With this configuration, the gap 9 is more annular in shape as there is no gravity effect on the free floating liner like there would be in a non-vertical orientation of the duct 10.

The inventive duct can be used in any configuration, vertical or non-vertical, which would include a horizontal configuration. In a typical HVAC installation, insulated duct is, by far, used most commonly in a horizontal configuration. In the vertical orientation and with the free floating liner, the gap between the liner and the insulation would be generally annular. For a non-vertical orientation, at least a portion of the liner 1 will rest on the helical member 3. When the duct is in the horizontal configuration, the liner 1 rests on the helical member along most of, if not the entire length of the helical member. There may be instances where two segments of duct are connected and the orientations of the two segments may not be the same, i.e., both not horizontal. As a result, only a portion of the free floating liner would be in contact with its bulk insulating layer. The manner of connecting duct segments may also cause some separation between the free floating liner and the bulk insulating layer in the area of connection. Put another way, even in the horizontal orientation, some portion of the free floating liner may not be in contact with the bulk insulating layer.

The orientation of the duct also affects heat loss through the duct walls. When the duct is in a vertical orientation, the heat loss through the walls is generally at a minimum as the heat rises vertically rather than horizontally through the duct wall. The heat loss through the duct wall increases as the duct orientation goes from vertical to a non-vertical orientation. The heat loss for a horizontal duct is also concentrated at the top of the duct as warm air in the duct rises.

With a horizontal configuration, the gap is largest above the liner as the liner rests on the helical member due to its free floating capability, see FIG. 1 for example. The maximum gap also coincides with the location where heat loss is the greatest as the heat would rise vertically and in a direction where the gap is the largest. The large gap above the liner coupled with the low-e surface on the outside of the liner, i.e., the reflective insulation system, means that the inventive insulating duct has a greater insulating value above the liner than prior art ducts. The reflective insulation system of the low-e surface on the outside of the liner and the maximum gap created by the free floating liner and helical member adds further insulation to the top of the duct where heat loss is the greatest. This added insulating effect means that the bulk insulation can have a lower R value and the duct can still meet industry standards R value requirements.

Taking the industry standard insulations of R4.2 and R6 and starting with a R4.2 for the insulation, the reflective insulation system between the liner and the bulk insulation can be made such that the overall duct rating is R6. Alternatively, an insulation of R6 can be selected and the reflective insulation system can be controlled so that the overall duct rating would be R8. Further, an insulation of R8 can be selected and the reflective insulation system can be controlled so that the overall duct rating would be R10. If non-industry standard bulk insulations were used, e.g., an R5 bulk insulation, these types of bulk insulations could also be employed, e.g., start with an R5 insulation and make an R8 duct. It is also possible to increase the insulating value of the duct by using low-e surfaces with lower emissivities. As these surfaces tend to be expensive, it is preferred to use the gap as the primary insulating-increase mechanism. As discussed in more detail below, one or more additional reflective insulation systems could be employed to increase the overall R value of the duct.

A method for determining the insulation value of these types of ducts is governed by ASTM C335, which is a standard test method for steady-state heat transfer properties of horizontal pipe insulation. This testing monitors temperature inside and outside of a duct being tested, with the outside monitoring occurring along the surface of the duct. As the inventive duct has its maximum insulating effect over the top of the liner due to the maximum gap created when the duct is horizontal, the inventive duct is configured to perform in a superior manner over prior art ducts when subjected to the ASTM C335 testing.

Another way to look at the function of the inventive duct is with respect to the Handbook. That is and within reason, the larger the air space (gap), the greater the thermal resistance of the reflective insulation system. The lowest thermal resistance of a reflective insulation system for any given air space (gap) is when the heat flow is in the upward direction.

For a non-vertical duct orientation, this normally represents the top of the duct or the location 13, opposite the resting location 11 of the free floating liner 1, see FIG. 1. By allowing the liner 1 to free float inside the non-vertically installed duct 10, gravity will orient the free floating liner 1 to create the maximum air space (gap) where heat flow is in the upward direction. The inventive duct thereby maximizes the thermal resistance in the heat flow up direction and minimizes thermal resistance in the heat flow down direction, thus producing a more energy efficient duct than prior art ducts.

Figure 8:
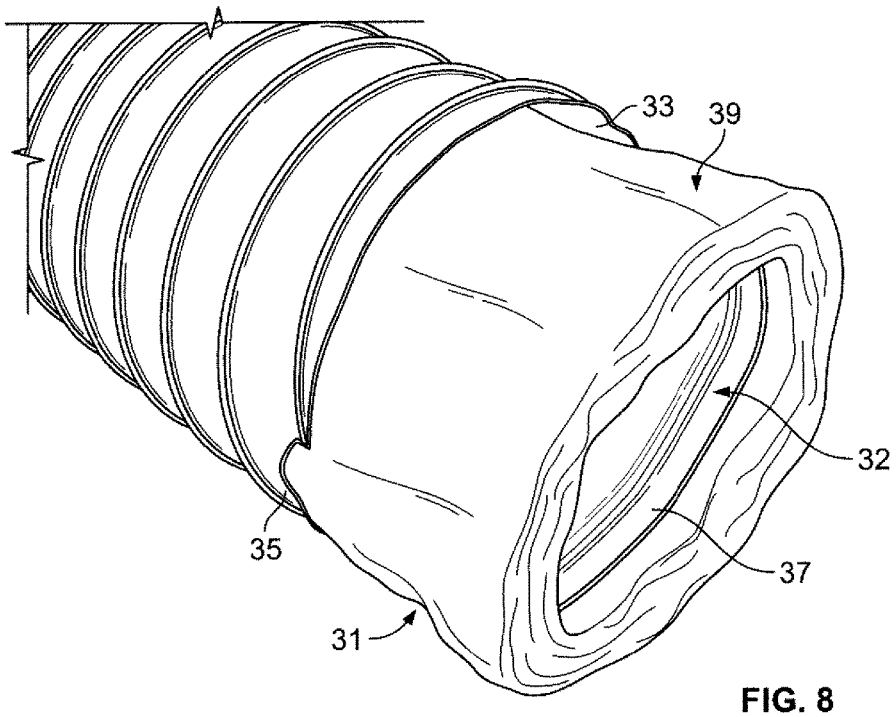
FIG. 8 is perspective view of a second embodiment of the inventive duct.
Figure 9:
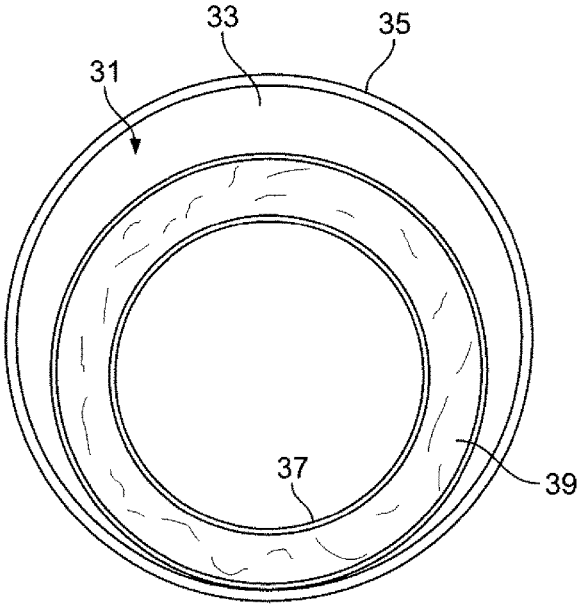
FIG. 9 is an end view of the duct of FIG. 8.
Figure 10:
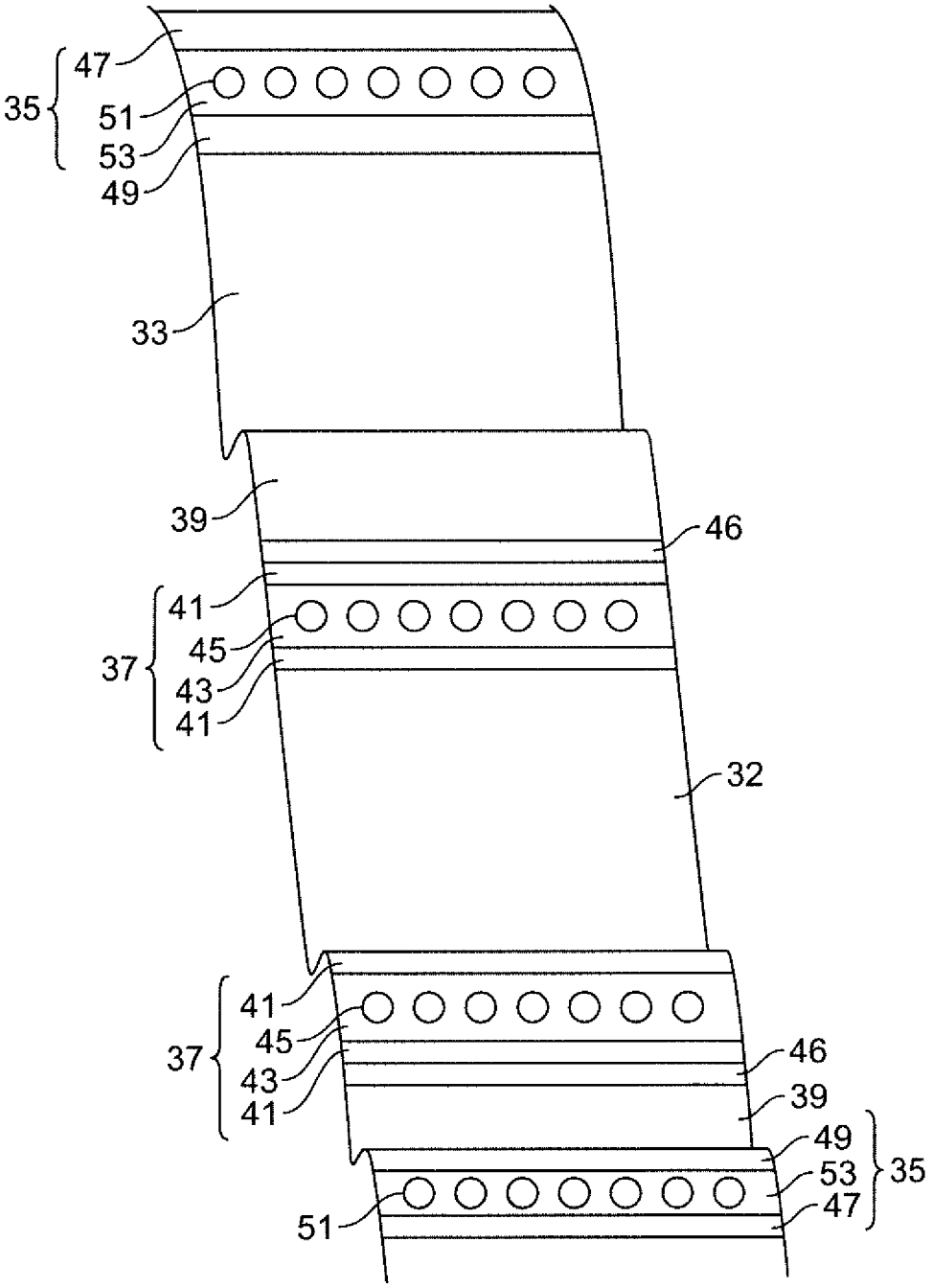
FIG. 10 is a schematic drawing of the layered construction of the inventive duct of FIG. 8.

A second embodiment of the invention is shown in FIG. 8-10 and is designated by the reference numeral 30. This embodiment still uses the reflective insulation system and bulk insulation as the embodiment of FIGS. 1-7, just in a different configuration.

FIG. 8 shows a perspective view of the duct 30 with a free floating liner assembly 31 which forms the passage 32 for fluid flow through the duct 30, a gap 33, and an outer member 35, which includes a vapor barrier function. The free floating liner assembly is partly removed from the inside of the outer member 35 to show more detail. The liner assembly 31 is made up of liner 37 and the bulk insulation 39. FIG. 9 shows a schematic end view of the duct 30.

The free floating liner assembly 31 differs in construction from the free floating liner 1 shown in FIG. 1 in two ways. First, the liner 37 of the assembly 31 does not include the low-e surface on the outer periphery of the liner. Second, the bulk insulation that was supported by the helical member in Figure us now positioned on the outside of the liner 37. Nevertheless, the free floating liner in this embodiment has the same characteristics and functions in the same way as described above for the free floating liner shown in the first embodiment and FIGS. 1-7.

The reflective insulation system of the duct 30 is made up of a low-e surface on the inside of the outer member 35 and the gap 33 formed between the outer member 35 and the free floating liner assembly 31.

A further detailed description of the various components of the duct 30 is described in connection with FIG. 10, which shows a schematic sectional view of the duct 30, showing the individual components of the liner assembly 31, the reflective insulation system, and outer member 35.

The liner 37 of the liner assembly 31 includes a pair of polymer films 41, secured together with an adhesive layer 43. As with the FIG. 1 embodiment, a helical support 45 is positioned between the films 41. A scrim could also be employed is desired. As the liner 37 does not include the low-e surface, the films 41 can be the same.

The bulk insulation 39 that surrounds the outer side of the liner 37 can be secured in any known fashion, preferably using an adhesive 46 as shown in FIG. 10. However, other forms of attachment could be used, including mechanical fastening such as staples, stitching, or the like or a combination of mechanical fastening and an adhesive. The bulk insulation can be secured to the liner or secured to itself to surround liner, or both, by either adhesives, mechanical fastening, or a combination thereof.

The outer member 35 has multiple functions. It serves as a vapor barrier similar to the function for the first embodiment. The outer member 35 also incorporates the helical member that supported the bulk insulation in the first embodiment. Further yet, the outer member 35 includes a low-e surface of the reflective insulation system. More particularly and with reference to FIG. 10, the outer member 35 has an outside polymer film 47 and an inside film 49, which contains the low-e surface. As with the first embodiment, the inside film 49 can be any type of a film or material that provides the low-e surface facing the bulk insulation 39 for the reflective insulation system.

A helical member 51 is positioned between the two films to provide support for the duct 30. An adhesive layer 53 is used to secure the two films together. In the first embodiment, the helical member between the free floating liner and the bulk insulation is sized to determine the gap of the reflective insulation system. In the second embodiment, the diameter of the outer member 35 determines the size of the gap between the low-e surface on the inside of the member 35 and the bulk insulation 39 of the liner assembly 31. As the helical member 51 provides support for the outer member, it is actually the helical member size that determines the gap 33 of the reflective insulation system, just like the helical member of the first embodiment.

All the variations described for the first embodiment of the invention in terms of materials, etc. apply to the second embodiment. Also, as the second embodiment includes both the reflective insulation system and the bulk insulation, the advantages gained by the first embodiment apply equally as well to the second embodiment.

Although a single reflective insulation system is illustrated in the drawings, one or more additional reflective insulation systems could be employed that form one or more additional gaps between duct components. For example, the vapor barrier of the first embodiment could include a low-e surface on an inside surface thereof and the vapor barrier could be sized with another helical member so that an air gap exists between the insulation layer 5 and the vapor barrier, thus creating a pair of reflective insulation systems.

The advantage in thermal properties of the inventive duct can be demonstrated mathematically. The thermal resistance of the duct is the total of the R value of the bulk insulating layer and the R-value of the reflective insulation system incorporated into the duct. Parallel path heat transfer methodology as explained in the Handbook can be applied to evaluate the total thermal resistance of the duct.

In this regard, actual mathematical based analysis was performed to calculate R values for a duct. R-values for a two-component hybrid duct insulation assembly were calculated using the procedure contained in ASTM STP1116. A cylindrical insulation assembly was used that had an outer layer of bulk fiberglass insulation with a specified thermal resistance. An inner airspace between the bulk insulation and the free floating liner represents a second component. The thermal resistance from the surface of the duct to the outer surface of the insulation assembly is the sum of the individual R-values.

Two types of assemblies were considered. In the first case (supported), the duct liner is supported to provide a concentric uniform thickness air space between the liner and the fiberglass layer. In the second case (unsupported), the free floating liner is allowed to rest on the bottom of the space interior to the fiberglass layer to form a variable air space. The air space varies from zero thickness to twice the thickness of the supported assembly. The bounding temperatures for the calculations are 100° F. on the surface of the duct and 50° F. on the exterior surface of the fiberglass layer. One surface of the interior airspace has emittance 0.05 to provide an effective emittance for the air space of 0.0497.

Certain assumptions and limitations were made as part of the analysis. It is assumed that the fiberglass insulation is not compressed by the free floating liner in the case of unsupported assemblies. It is also assumed that radial convection is absent in the enclosed reflective air spaces. This assumption believed to be valid for small air gaps (less than 0.5 in.) but weakens as the air gap dimension increases. The stated R-value for the fiberglass layer is the as-installed value.

The supported liner corresponds to the configuration shown in FIG. 7, wherein the air gap is annular in shape. The unsupported free floating liner corresponds to the embodiment shown in FIG. 1.

The analysis was done using two R values, one being R4.2 and the other being R6. The gap dimension was varied and calculations were made based on different gap dimensions. For the supported liner and R4.2 insulation, the gap dimensions were 0.5 inches, 0.625 inches, 0.75 inches, 1.0 inches, 1.25 inches, 1.5 inches and 1.75 inches. For the unsupported free floating liner and R4.2, the dimensions represent the maximum gap dimension and, as a result, were twice that of the supported liner, that is 1.0 inches, 1.25 inches, 1.5 inches, 2.0 inches, 2.5 inches, 3 inches, and 3.5 inches. The reason that the gap dimension is twice that of the supported liner is that the gap is formed by the free floating liner resting on the bottom of the insulation thereby reducing the gap dimension to zero at the bottom 11 and doubling the gap dimension at the top 13, see FIG. 1. For the R6 insulation analysis and the supported liner, the gap dimensions were 0.25 inches, 0.50 inches, 0.625 inches, 0.75 inches, 1.0 inches, 1.25 inches, and 1.5 inches. For the unsupported free floating liner and R6 insulation, the maximum gap dimensions were twice that of the supported liner, that is 0.5 inches, 0.625 inches, 1.0 inches, 1.25 inches, 1.50 inches, 2.0 inches, 2.5 inches, and 3.0 inches.

Figure 11:
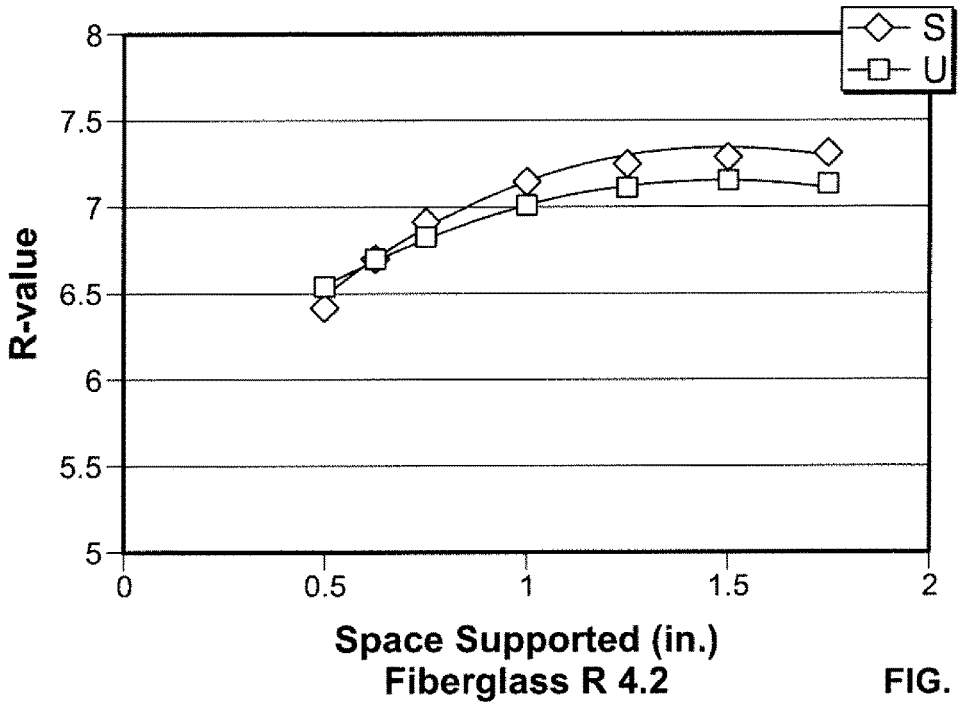
FIG. 11 is a graph representing a heat transfer analysis using an R4.2 insulation.
Figure 12:
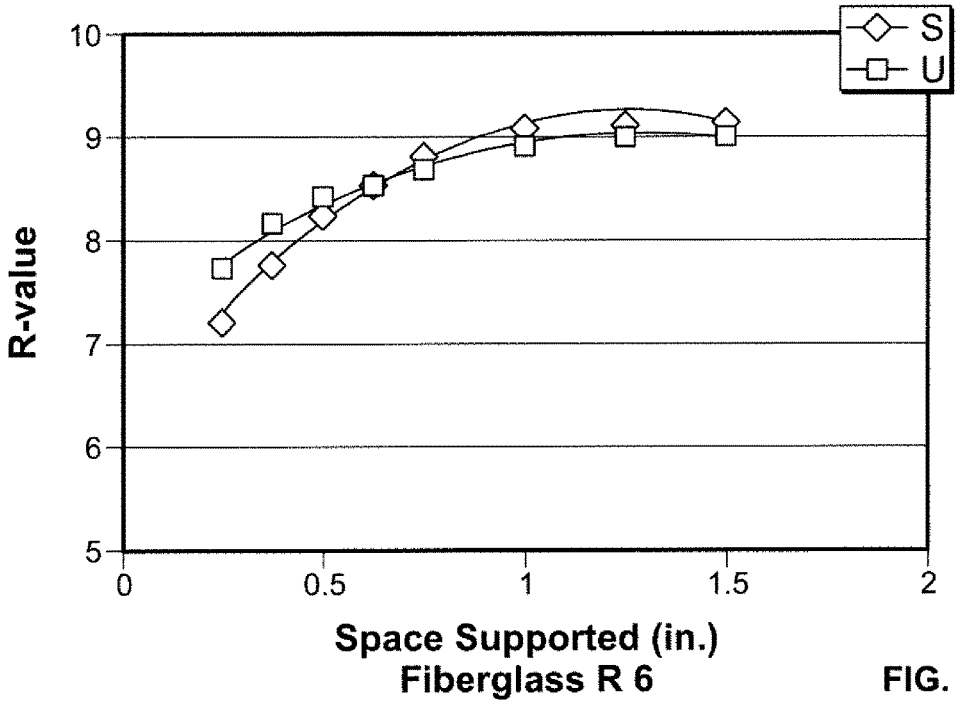
FIG. 12 is a graph representing a heat transfer analysis using an R6 insulation.

The results of the analysis are plotted in graphs comparing R-value and the space contained in the supported and unsupported duct assemblies. FIG. 11 shows the R4.2 analysis and FIG. 12 shows the R6 analysis. The supported duct assembly is represented by the diamond and the unsupported inventive duct assembly is represented by the square. It should also be noted that the x-axis is the space for the supported duct assembly and this spacing needs to be doubled for the unsupported inventive duct assembly.

What FIG. 11 shows is that for spaces on the lower end of the range, the unsupported inventive duct assembly performs better in terms of R value that the supported duct assembly. A crossover occurs between the 0.5 inch and 1.0 inch space for the supported duct assembly (corresponding to between a 1.0 inch and 2.0 inch space in the unsupported inventive duct assembly. For most applications, the type of commercial duct size commonly used in the unsupported inventive configuration would employ about a 1 inch air gap. Thus, the better performance of the unsupported inventive duct assembly is right in the range for typical duct sizes.

FIG. 12 shows a similar result as FIG. 11. For smaller spaces, the unsupported inventive duct assembly provides a higher R value and performance is better for the supported duct assembly when the two curves cross over in the vicinity of the 0.5 inch space supported and 1.0 inch space unsupported.

An analysis was also performed using an R5 insulation. This analysis showed that using a 2.8 inch air gap for the reflective insulation system within the unsupported inventive duct assembly achieved an R8 insulating value. This means that not only can R6 insulation be used in the inventive duct assembly to get to an R8 insulating value, R5 can be used as well.

The results in FIGS. 11 and 12 show that in the range of industry-standard R-values, the inventive duct assembly with the unsupported, free floating liner provides the same R-value as the concentrically-located liner without the need to support the liner within the air space. Both designs achieve required R-values with less bulk insulating, but the inventive duct assembly does so without the restrictions of providing support for the duct liner. Thus, the advantages of the invention as detailed below can be realized.

There are a number of advantages in connection with the presence of the gap caused by the free floating liner 1 and the location of the low-e surface. That is, when using the gap-creating free floating liner and helical member 3 in combination with the low-e film, additional insulating value is provide to the duct 10. With the presence of the low-e surface and the existence of the air gap, the duct 10 can have an additional R value of up to R4 in insulating value. What this means is for an industry standard R8 duct, it is conceivable that an R4.2 insulation can be used for the bulk insulating layer 5 and the duct would still meet the requirement of an R8 duct, particularly if more than one reflective insulation system were used or very low emitting low-e surfaces were used. Similarly, if an R6 duct is required in a particular installation, the inventive duct can provide an R6 insulation value using an R4.2 insulation for the bulk insulating layer 5. This is a significant cost savings as the price of the insulation is by far the most expensive component of these types of ducts.

The presence of the free floating liner 1 also makes the joining of ends of liners 1 easier. Typically, a number of liners are connected together for a given installation. Since the free floating liner 1 is not attached to the helical member 3 or insulation 5, the helical member 3 along with the bulk insulating layer 5 and vapor barrier 7 can be pushed back from an end of the free floating liner 1 and the end is more exposed to facilitate joining to the end of another free floating liner when installing the duct in a given location.

The ability to use less insulation in the duct also presents a space saving. As the duct is normally packaged in compressed form and in 25 foot lengths, the amount of space needed for storing the packaged ducts can be quite substantial. By being able to use a lower R value insulation, e.g., R6 instead of R8, less insulation is used and a considerable space savings is obtained, which translates into less warehousing costs and lower transportation costs. Even though there would be a weight increase by the oversize helical member 3, the savings in weight of reduced insulation still results in a net weight loss.

More particularly, the inventive duct creates a significantly reduced package length while containing the same duct length. This is accomplished by the following:

1) the presence of an air gap between the inner core and fiberglass insulation better allowing the evacuation of air from the insulation during the compression of the product;

2) the air gap also allowing space for the inner core to freely move during the compression process (this gap allows for both the layer of insulation and the inner core to better fold and flatten inside the duct construction); and 3) the presence of an additional wire support helix that holds the insulation against the outer jacket also providing increased crush resistance during the packaging process.

Currently, the current flexible duct industry compresses and packages product in both corrugated boxes and polyethylene bags. Standard ducts come in twenty-five foot lengths ranging from four to twenty-two inch inner diameter product. The industry standard pack height for R4.2 and R6 box and bag product is approximately 20"-25". The industry standard pack height for R8 box and bag product is approximately 25"-30". The inventive duct allows for the duct to be compressed and packed in a box or bag of considerably less height (length), for example, at 16⅝" without damaging any portion of the product (inner core, support helix, fiberglass insulation, and outer jacket). In contrast, the current standard flexible duct would have permanent deformation to the core at the new pack height. It has been determined that current industry standard flexible duct can only be compressed and packaged no less than 20"-25" pack height before core damage occurs. Damage to core will cause reduced air flow and/or leakage.

The following chart shows packing length and ratios for 25 foot products.

| | | |
|---|---|---|
| Prior art R6 Package height range | 20" | 25" |
| Prior art R6 Piece to Package height ratio | 15:1 | 12:1 |
| Inventive duct R6 Package height | 16⅝" | |
| Inventive duct R6 Piece to Package height ratio | 18:1 | |
| Prior arty R8 Package height range | 25" | 30" |
| Prior art R8 Piece to Package height ratio | 12:1 | 10:1 |
| Inventive duct R8 Package height | 16⅝" | |
| Inventive duct R8 Piece to Package height ratio | 18:1 | |

The new pack height allows for increased skid capacity for box and bag product. This increased capacity allows for 33%-50% more inventive duct to be loaded and shipped on containers to the customer. Typically, flexible duct freight cost is approximately 8% of the total product cost of sales, so the reduced package height offers a significant savings to the flexible duct manufacturer.

The new pack height also allows for the customer to utilize 33%-50% less warehouse space to store the product before being used. Flexible duct is typically the lowest value item for HVAC equipment that is stored in a distributor's warehouse. Given the fact that this product is occupying 30%-50% less space in the warehouse the distributor has more space for higher value product to stock.

The reduced compression and overall duct package length also means that there is approximately 33%-50% less package material being used for the total package. This ensures that less corrugated box and polyethylene bag is used per packaged duct, thereby resulting in less packaging material cost for the product.

Another advantage of the inventive duct is the additional helical member, which provides additional crush resistance for the duct assembly.

The presence of the gap also allows the duct to recover faster than conventional ducts. As noted above, the duct is in a compressed form when made and delivered to an installation site. Once the packaging is open, the duct has to recover or expand sufficiently before it is ready for installation. The gap of the inventive duct allows air to more easily infiltrate the duct and accelerate the recovery or expansion of the duct. This leads to improved productivity during duct installation as the installer does not have to wait as long for the duct to recover.

Another significant advantage of the inventive duct pertains to a supported, concentric duct with an air space such as the one used in the mathematical analysis discussed above. The inventive duct is much lower in cost to manufacture as it does not require any support structures to hold the liner in a concentric position with respect to other duct components.

For Class 1 flexible ducts, the duct material would be tested to and comply with UL 181 standards, which includes flame resistance at a minimum to pass the Flame Penetration test method in UL 181.

The invention also includes the method of supplying conditioned air using the inventive duct.

In another embodiment, the invention includes a method of making an insulated duct that includes a liner, a helical member, a layer of bulk insulation and a vapor barrier. The inventive method comprises making the liner free floating in the duct and including a reflective insulation system in the duct, the reflective insulation system comprising a low-e surface and a gap between the low-e surface and the layer of bulk insulation, and positioning the helical member with respect to the low-e surface and the bulk insulation layer to form the gap, and either using one of an R5 or R6 insulation for the bulk insulating layer to form an insulating duct having about at least an R8 value; or using an R4.2 insulation for the bulk insulating layer to form an insulating duct having at least an R6 value.

In the inventive method in the first embodiment, the free floating liner is provided and made with a low-e film on an outer surface thereof. The helical member is oversized, i.e., not attached to the free floating liner or the bulk insulating layer to create a gap between the free floating liner and bulk insulating layer. With the construction of the free floating liner and helical member, an R5 or an R6 insulation can be used for the layer of insulation and an R8 value insulated duct is produced. Alternatively, an R4.2 insulation layer can be used to create an R6 value insulated duct. The ability to create an industry standard insulated duct, e.g., R6 or R8 with a lower R value insulation is accomplished by using the unique arrangement of the gap formed by the free floating liner 1 and the low-e film 17 on the outer surface of the free floating liner 1 and the helical member 3 to provide the increase in insulating value. With this, the bulk insulating layer 5 of the duct 10 can have an R6 value to provide an overall R8 insulation for the duct 10. Similarly, with a bulk insulating layer 5 having an R4.2 value, the overall insulation of the duct can be about R6 or R8 depending on the size of the gap 9 created using the helical member 3.

The method for the second embodiment comprises placing the low-e surface on an inside surface of the vapor barrier, surrounding the outside surface of the free floating liner with the bulk insulation layer, and making the helical member part of the vapor barrier to create the gap of the reflective insulation system between the low-e surface on the vapor barrier and the bulk insulation layer surrounding the free floating liner.

Another embodiment of the invention entails an insulated duct that only uses at least one free floating liner to produce a variable air gap and at least one reflective insulation system to create a given R value for the duct. In contrast to the embodiment discussed above for FIGS. 1-12, this embodiment does not employ any bulk insulation as part of the flexible duct.

Figure 13:
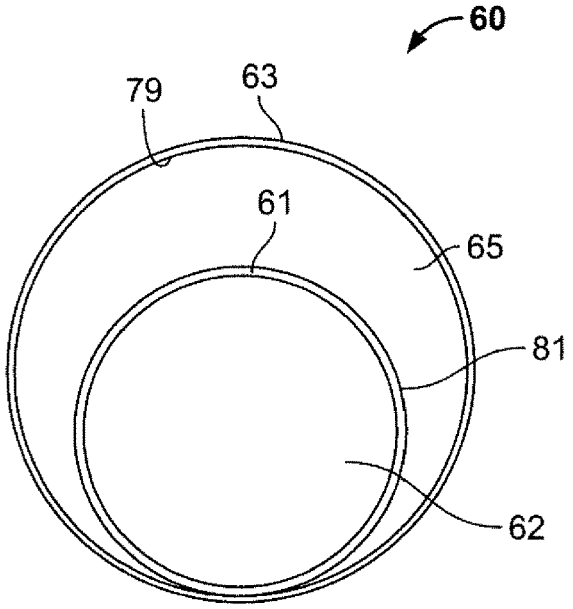
FIG. 13 shows a side view of another embodiment of the invention that is bulk insulation-free.

FIG. 13 shows an end view of the new embodiment with the duct designated by the reference numeral 60. The duct 60, oriented horizontally, includes a free floating liner 61 defining a channel 62 and a surrounding outer member 63 with a variable spaced gap 65 positioned between the free floating liner 61 and the outer member 63.

In this embodiment, the construction of the free floating liner 61 tracks that of the FIG. 1 embodiment. That is and with reference to FIG. 14, the wall of free floating liner 61 is made up of a polymer film 67 and a low emissivity film 69 (low-e film). The low-e film is located on the outer surface of the free floating liner 1 and it faces the gap 65, although it could also be situated on the inner surface 79 of the outer member 63.

The low-e film 69 is made of a polymer film 71 and reflective coatings 73. A protective coating (not shown) can cover the reflective, e.g., metallic, coatings 73. The low-e film 69 is secured to the polymer film 67 using an adhesive 75. A helical support 77 is shown positioned between the films 67 and 69. The placement of the low-e film 69 on the outside of the free floating liner 61 and facing the variable space gap 65 creates the reflective insulation system that provides insulating value to the overall duct 60. The additional R value created by the combination of the low-e film 69 and gap 65 can range from R0 to about R4 depending on the size of the gap 65 and the emissivity of the low-e surface employed.

The outer member 63 can be constructed like the vapor barrier 7 in the embodiment of FIG. 1 or the outer member of FIGS. 8-10, that is, it can include a helical support or other structure so that it is self-supporting and maintains the necessary variable space air gap with respect to the adjacent free floating liner. As the construction of these types of liners are well known and detailed in FIG. 10, for example, the detail thereof is omitted in FIGS. 13 and 14. Instead of the sandwich construction of FIG. 10, wherein the helical member is positioned between two films, the outer member could be constructed by the helical member being adhered to just one tubular film or the helical member could be separate from the tubular film. In this latter embodiment, the helical member would exert outward force against and support the tubular material to create the variable space air gap with the free floating liner. This would be similar to the helical member supporting the bulk insulation in the embodiment of FIG. 1.

If so desired, the low-e-film could be located on the inner surface 79 of the outer member 63 rather than an outer surface 81 of the free floating liner 61, see FIG. 13.

In the embodiment of FIG. 13, the reflective insulation system is comprised of the variable air gap 65 and a low-e surface, associated with either the outer surface of the free floating liner 61 or the inner surface of the outer member 63. The low-e surface is analogous to that described for the FIG. 1 embodiment.

Figure 15:
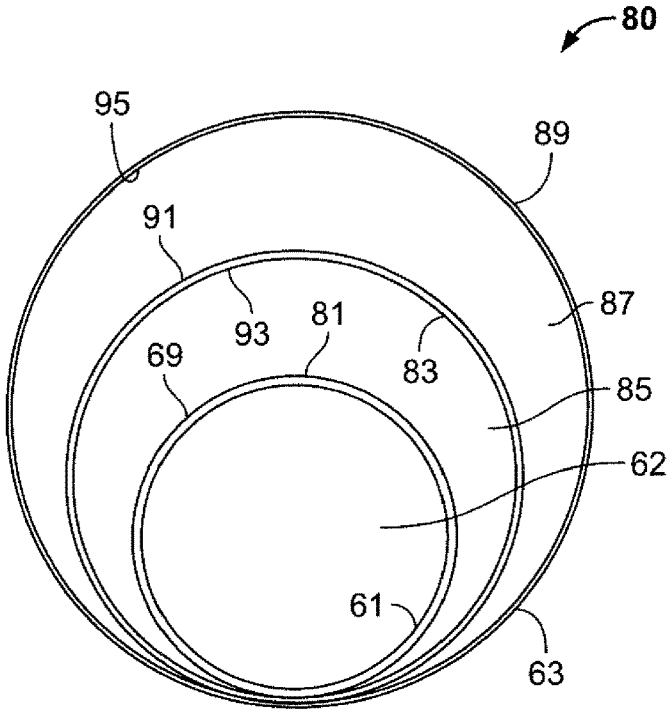
FIG. 15 is an end view of the inventive duct of FIG. 13 employing an additional free floating liner.

FIG. 15 shows another embodiment that utilizes two reflective insulation systems that utilize two free floating liners. This duct, oriented horizontally, is designated by the reference numeral 80 and includes an additional free floating liner 83 positioned between the free floating liner 61 and the outer member 89. In this embodiment, there are two variable space air gaps, one being designated as 85 between the two free floating liners 61 and 83 and a second variable space air gap 87 positioned between the second free floating liner 83 and the outer member 89. The outer member 89 is analogous to the outer member 63 of the embodiment of FIG. 13.

The second free floating liner 83 can be constructed in the same manner as the free floating liner 61 so that there is a low-e surface on the outer surface 91 of the free floating liner 83 and facing the second gap 87 to create a second reflective insulation system. As with the embodiment of FIG. 13, the low-e surface of the first reflective insulation system could be on the inner surface 93 of the second free floating liner 83 rather than on the outer surface of the free floating liner 61.

For the second reflective insulation system, the low-e surface can be located on the inner surface 95 of the outer member 89 rather than on the second free floating liner 83. Thus, it would be possible to have the second free floating liner to have the low-e surface for each of the reflective insulation systems.

Any combination of the low-e surfaces on the outer surface 81 of the first free floating liner, the inner surface 93 of the second free floating liner, the outer surface 91 of the second free floating liner, and the inner surface 95 of the outer liner 89 can be employed to create the two reflective insulation systems for the duct 80.

For the embodiment of FIG. 15, it is believed that this duct could provide an R value of about 4.2 with air gaps like that used in the FIG. 1 embodiment. What this means is that the duct 80 can be used as a replacement for a conventional insulated duct that uses bulk insulation and is designed to have an R 4.2 value for its intended application. Using the inventive duct creates a huge saving in terms of cost as the bulk insulation is the costliest item in these types of ducts and the inventive duct is bulk insulation-free. Moreover, not having to use bulk insulation also creates considerable advantages in terms of storage and transportation costs as the inventive ducts can be stored in a more compact fashion, both in storage and during transport. Also, because the duct is insulation free, it weighs less than conventional ducts, thus creating savings in transportation costs.

While not illustrated, a duct could have three or even more nested free floating liners. The more free floating liners that are used; the higher the R value will be for a given duct.

Figure 14:
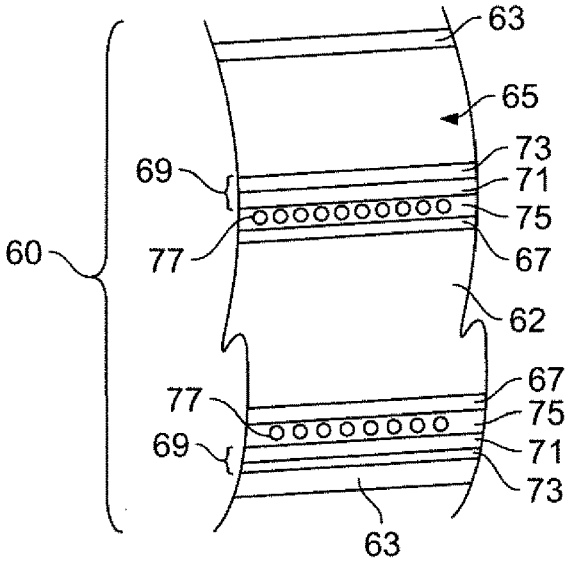
FIG. 14 is a schematic drawing of the layered construction of the inventive duct of FIG. 13.

In certain instances, the duct of FIGS. 13-15 could be used in applications that would not require passing the UL 181 flame penetration test (see Standard for Factory-Made Air Ducts and Air Connectors, Edition 11, Section 10.1-10.5). However, in other instances, the duct may be used in applications that would require passing the UL 181 flame penetration test. In such an instance, the combined various layers and liners of the inventive duct that does not use bulk insulation should be constructed with materials that will enable it to pass the UL 181 flame penetration test for these types of flexible ducts. Passing this test without the presence of a bulk insulation is more difficult due to test temperatures above melting points of polymeric materials. Therefore, duct materials for this embodiment would include a material or materials that can withstand these high temperatures.

Figure 16:
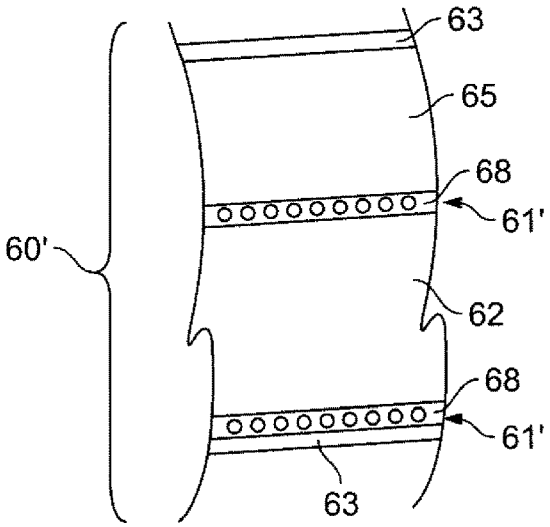
FIG. 16 is a schematic drawing of the alternative construction of the inventive duct of FIG. 14.

FIG. 16 shows an alternative to the embodiment of FIG. 14, FIG. 14 depicts the materials used in the FIGS. 1-12 embodiments for the free floating liners of FIGS. 13 and 15. However, in instances where the duct of FIG. 13 or 15 would have to pass the UL 181 flame penetration test, a more preferred construction of the wall of the free floating liner is shown in FIG. 16. The duct is designated by the reference numeral 60' an includes a free floating liner 61' positioned within the outer member 63. The free floating liner 61' includes the helical member like that used in the free floating liner 61. The wall construction for the free floating liner 61' is designated as 68 and can include a one or a combination of layers that would be of the type that would pass the flame penetration test noted above. Examples of these materials include woven fabrics, carbon-containing films with carbon materials like carbon fibers, carbon nanotubes and the like, metal or alloy foils or laminates with these materials, films with refractory materials like aluminum oxide, silicon oxide, and the like, various silicate materials, or combinations of these different materials. The helical member could be sandwiched between materials using an adhesive like in the already-disclosed embodiments above or embedded in or adjacent to one or more of the materials used for the free floating liner.

While the free floating liner in FIG. 16 is designed to have a one or a combination of materials to pass the flame penetration test, the outer member could be constructed with the same material(s) to pass the flame penetration test and the free floating liner could have a construction similar to FIG. 2, 10, or 14. In yet a further alternative, both the free floating liner and the outer member could have constructions in terms of the wall material(s) so that the flame penetration test could be passed.

Of course, the bulk insulation of the embodiment of FIGS. 1-12 can be incorporated into the ducts 60 and 80 to provide even additional insulation value while still maintaining the reflective insulation system(s). More particularly, bulk insulation could surround the free floating liner 61 of FIG. 13 or both of the free floating liners 61 and 83 of FIG. 15 and the low-e surface could be appropriately located to maintain the presence of the reflective insulation system(s). Alternatively, the bulk insulation layer could be positioned in the variable space air gaps using the helical member used to support the insulation and create the variable space air gap like in the embodiment of FIGS. 1-12.

As such, an invention has been disclosed in terms of preferred embodiments thereof which fulfills each and every one of the objects of the present invention as set forth above and provides a new and improved insulated flexible duct and method of use.

Of course, various changes, modifications and alterations from the teachings of the present invention may be contemplated by those skilled in the art without departing from the intended spirit and scope thereof. It is intended that the present invention only be limited by the terms of the appended claims.

We claim:

1. An insulated duct comprising:

a free floating liner that floats inside the insulated duct;

a layer of bulk insulation surrounding the free floating liner, a helical member, at least one reflective insulation system comprising a low-e surface and a gap between the low-e surface and the layer of bulk insulation, and a vapor barrier forming an outside layer of the insulated duct, wherein the helical member, layer of bulk insulation, and free floating liner are positioned in the insulated duct to form the gap between the bulk insulation layer and the low-e surface; and further wherein the free floating liner is able to freely move at least transversely within the insulated duct.

2. The insulated duct of claim 1, wherein the low-e surface is on an outside surface of the free floating liner, and the helical member is positioned between the low-e surface of the free floating liner and the bulk insulation layer to form the gap.

3. The insulated duct of claim 2, wherein the helical member is not attached to either the bulk insulation layer or the free floating liner.

4. The insulated duct of claim 2, wherein the free floating liner further comprises a polymer film forming an inside surface of the liner, and another helical member disposed between the polymer film and the low-e surface.

5. The insulated duct of claim 1, wherein the bulk insulation layer is adhered to an outside surface of the free floating liner to form a free floating liner assembly, the low-e surface is on an inside of the vapor barrier, and the helical member is positioned in the vapor barrier to surround the low-e surface, the gap formed between the low-e surface on the inside of the vapor barrier and an outer surface of the bulk insulation.

6. The insulated duct of claim 5, wherein the vapor barrier further comprises a pair of polymer films forming inside and outside surfaces of the vapor barrier with the helical member disposed between the polymer films.

7. The insulated duct of claim 5, wherein the bulk insulating layer is adhered to itself or to the free floating liner using an adhesive or mechanical fastening such as staples or stitching, or a combination thereof.

8. The insulated duct of claim 1, wherein the bulk insulating layer is a fiberglass, preferably a fiberglass having an insulating value of one of R8, R6, R5, or R4.2.

9. The insulated duct of claim 1, wherein the gap ranges from 0.25 to about 5.5 inches, preferably up to about 3.0 inches.

10. In a method of making an insulated duct of R8 or R6 insulation value that includes a liner, a helical member, a layer of bulk insulation and a vapor barrier, the improvement comprising:

a) making the liner free floating in the duct such that the liner is able to freely move at least transversely within the duct, and including a reflective insulation system in the duct, the reflective insulation system comprising a low-e surface and a gap between the low-e surface and the layer of bulk insulation, and positioning the helical member with respect to the low-e surface and the bulk insulation layer to form the gap, and either:

b) using one of an R5 or R6 insulation for the bulk insulation layer to form an insulated duct having about at least an R8 value;

c) using an R4.2 insulation for the bulk insulating layer to form an insulated duct having at least an R6 value; or d) using an R8 insulation for the bulk insulating layer to form an insulated duct having at least an R10 value.

11. The method of claim 10, further comprising placing the low-e surface on an outside of the free floating liner and positioning the helical member between the low-e surface and the bulk insulation layer to form the gap of the reflective insulation system.

12. The method of claim 10, further comprising placing the low-e surface on an inside surface of the vapor barrier, surrounding the outside surface of the free floating liner with the bulk insulation layer, and making the helical member part of the vapor barrier to create the gap of the reflective insulation system between the low-e surface on the vapor barrier and the bulk insulation layer surrounding the free floating liner.

13. A method of supplying conditioned air to a space using an insulated duct, comprising:

providing an insulated duct, the insulated duct further comprising:

a free floating liner that floats inside the insulated duct;

a layer of bulk insulation surrounding the free floating liner, a helical member, at least one reflective insulation system comprising a low-e surface and a gap between the low-e surface and the layer of bulk insulation, and a vapor barrier forming an outside layer of the insulated duct, wherein the helical member, layer of bulk insulation, and free floating liner are positioned in the insulated duct to form the gap between the bulk insulation layer and the low-e surface; and further wherein the free floating liner is able to freely move at least transversely within the insulated duct;

supplying conditioned air to the space using the insulated duct.

14. An insulated flexible duct comprising:

an outer member, at least one free floating liner positioned inside the outer member, the free floating liner being able to freely move at least transversely within the outer member so as to form a variable space air gap between the at least one free floating liner and the outer member, and at least one reflective insulation system comprising a low-e surface on either an outer surface of the at least one free floating liner or an inner surface of the outer member and the variable space air gap, with the low-e surface facing the variable space gap;

wherein the outer member serves as a vapor barrier.

15. The insulated flexible duct of claim 14, further comprising a layer of bulk insulation positioned in at least the variable space air gap.

16. The insulated flexible duct of claim 14, wherein the at least one free floating liner further comprises a polymer film forming an inner surface of the liner, and a helical member disposed between the polymer film and the low-e surface on the outer surface thereof.

17. The insulated flexible duct of claim 14, wherein the outer member further comprises a wall with a helical member embedded therein, a wall with a helical member attached to the wall, or a wall with a helical member exerting outward force on the wall.

18. The insulated flexible duct of claim 14, wherein a layer of bulk insulation surrounds the free floating liner such that the layer of bulk insulation and the free floating liner freely move at least transversely within the outer member.

19. The insulated flexible duct of claim 18, wherein the reflective insulation system is on the inner surface of the outer member.

20. The insulated flexible duct of claim 14, wherein the reflective insulation surface is on the outer surface of the free floating liner.

21. An insulated flexible duct comprising:

at least one free floating liner that floats inside an outer member and forms a variable space air gap between the at least one free floating liner and the outer member, and at least one reflective insulation system comprising a low-e surface on either an outer surface of the at least one free floating liner or an inner surface of the outer member and the variable space air gap, with the low-e surface facing the variable space gap;

wherein the outer member serves as a vapor barrier, wherein the insulated flexible duct further comprises:

a second free floating liner surrounding the at least one free floating liner so as to form the variable space air gap, the second free floating liner floating inside the outer member, the low-e surface of the at least one reflective insulation system on either the outer surface of the at least one free floating liner or an inner surface of the second free floating liner, a second variable space air gap formed between the outer surface of the second free floating liner and the inner surface of the outer member;

a second reflective insulation system comprising a second low-e surface on either the outer surface of the second free floating liner or the inner surface of the outer member and the second variable space air gap, with the second low-e surface facing the second variable space gap.

22. The insulated flexible duct of claim 21, further comprising a layer of bulk insulation positioned in at least the variable space air gap.

23. The insulated flexible duct of claim 21, wherein the second free floating liner further comprises a polymer film forming an inner surface of the liner, and a helical member disposed between the polymer film and the low-e surface on the outer surface thereof.

24. A method of supplying conditioned air to a space using an insulated flexible duct, comprising:

providing an insulated flexible duct, the insulated flexible duct further comprising:

an outer member, at least one free floating liner positioned inside the outer member, the free floating liner being able to freely move at least transversely within the outer member so as to form a variable space air gap between the at least one free floating liner and the outer member, and at least one reflective insulation system comprising a low-e surface on either an outer surface of the at least one free floating liner or an inner surface of the outer member and the variable space air gap, with the low-e surface facing the variable space gap;

wherein the outer member serves as a vapor barrier; and supplying conditioned air to the space using the insulated flexible duct.

* * * * *